US012590720B2

(12) United States Patent
Shaffer

(10) Patent No.: US 12,590,720 B2
(45) Date of Patent: Mar. 31, 2026

(54) AIR CONDITIONING APPLIANCES AND HEAT RECOVERY FEATURES THEREOF

(71) Applicant: Haier US Appliance Solutions, Inc., Wilmington, DE (US)

(72) Inventor: Timothy Scott Shaffer, La Grange, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 359 days.

(21) Appl. No.: 18/350,142

(22) Filed: Jul. 11, 2023

(65) Prior Publication Data

US 2025/0020347 A1 Jan. 16, 2025

(51) Int. Cl.
*F24F 7/007* (2006.01)
*F24F 7/00* (2021.01)

(52) U.S. Cl.
CPC ..... *F24F 7/007* (2013.01); *F24F 2007/005* (2013.01)

(58) Field of Classification Search
CPC .... F24F 7/007; F24F 2007/005; F24F 12/001; F24F 12/006; F24F 2012/008
See application file for complete search history.

(56) References Cited

U.S. PATENT DOCUMENTS 5,485,878 A 1/1996 Derks
5,761,908 A * 6/1998 Oas ..... F24H 4/06 454/238
7,942,193 B2 5/2011 Caldwell
8,939,826 B2 1/2015 Zorzit et al.
2012/0312035 A1* 12/2012 Boucher ..... F24F 1/022 62/99
2014/0138076 A1* 5/2014 Heberer ..... F24F 12/006 62/99
2021/0389014 A1* 12/2021 Moffet ..... F24F 11/74

OTHER PUBLICATIONS

Panasonic, Installation Instructions for "Spot Energy Recovery Ventilator (ERV) Model No. FV-04VE1", 2012, 20 pages.

* cited by examiner

*Primary Examiner* — Cassey D Bauer
(74) *Attorney, Agent, or Firm* — Dority & Manning, P.A.

(57) ABSTRACT

An air conditioning appliance may include an air plenum, a recovery casing, a first recovery exhaust fan, a heat exchanger core, and a thermal cutoff. The recovery casing may be attached to the air plenum. The recovery casing may define an outdoor casing inlet downstream from the air plenum and an indoor casing outlet downstream from the outdoor casing inlet along an external recovery flow path. The recovery casing may further define an indoor casing inlet and an outdoor casing outlet along an internal recovery flow path. The first recovery exhaust fan may be mounted within the recovery casing along the external recovery flow path. The heat exchanger core may be disposed along the external recovery flow path and the internal recovery flow path. The thermal cutoff may be mounted within the recovery casing in operable communication with the first recovery exhaust fan.

18 Claims, 7 Drawing Sheets

AIR CONDITIONING APPLIANCES AND HEAT RECOVERY FEATURES THEREOF

FIELD OF THE DISCLOSURE

The present subject matter relates generally to air conditioning appliances, and more particularly to assemblies for recovering heat at supplemental air.

BACKGROUND OF THE DISCLOSURE

Air conditioner or air conditioning appliance units are conventionally used to adjust the temperature within structures such as dwellings and office buildings. In particular, one-unit type room air conditioner units, such as single-package vertical units (SPVU), may be used to adjust the temperature in, for example, a single room or group of rooms of a structure. A typical one-unit type air conditioner or air conditioning appliance includes an indoor portion and an outdoor portion. The indoor portion generally communicates (e.g., exchanges air) with the area within a building, and the outdoor portion generally communicates (e.g., exchanges air) with the area outside a building. Accordingly, the air conditioner unit generally extends through, for example, an outer wall of the structure. Generally, a fan may be operable to rotate to motivate air through the indoor portion. Another fan may be operable to rotate to motivate air through the outdoor portion. A sealed cooling system including a compressor is generally housed within the air conditioner unit to treat (e.g., cool or heat) air as it is circulated through the indoor portion of the air conditioner unit. One or more control boards are typically provided to direct the operation of various elements of the particular air conditioner unit.

Frequently, the indoor space may need to draw in air from the outdoors (e.g., make-up air). For example, if a vent fan is turned on in a bathroom or air is otherwise ejected from the indoor space, fresh air from the outdoors is required. Depending on, for example, the efficiency of the weather stripping around doors and windows, some make-up air could simply be drawn into the indoors by cracks or other openings. If such cracks are not sufficient, the flow of make-up air may be insufficient or too slow. Furthermore, government regulations, such as fire codes may require that cracks or openings be eliminated as much as possible—precluding a sufficient flow of make-up air. Accordingly, an air conditioner unit that can allow for the introduction of make-up air into the indoor space would be useful. Unfortunately, previous attempts to provide such make-up air have unsatisfactory. For example, previous systems ducting make-up air through a housing of the air conditioner unit may make it difficult to meet various government standards (e.g., related to heat management). One of the common issues with make-up air is that such air is completely unconditioned and may be at a vastly different temperature than the indoor air—or the selected temperature that the air conditioner is working to achieve. In certain circumstances, frost may even begin to accumulate within the appliance, which may block air flow and further hinder performance.

As a result, it would be useful to provide an air conditioning appliance or door assembly that includes features for addressing one or more of the above issues. In particular, it may be advantageous to provide an appliance or assembly with features for efficiently supplying ambient or make-up air to an indoor region.

BRIEF DESCRIPTION OF THE DISCLOSURE

Aspects and advantages of the invention will be set forth in part in the following description, or may be obvious from the description, or may be learned through practice of the invention.

In one exemplary aspect of the present disclosure, an air conditioner unit is provided. The air conditioner unit may include an air plenum, a recovery casing, a first recovery exhaust fan, a heat exchanger core, and a thermal cutoff. The air plenum may be receivable within a structure wall. The recovery casing may be attached to the air plenum. The recovery casing may define an outdoor casing inlet downstream from the air plenum and an indoor casing outlet above and downstream from the outdoor casing inlet along an external recovery flow path. The recovery casing may further define an indoor casing inlet and an outdoor casing outlet along an internal recovery flow path. The first recovery exhaust fan may be mounted within the recovery casing along the external recovery flow path to motivate airflow therethrough. The heat exchanger core may be disposed along the external recovery flow path and the internal recovery flow path to exchange heat therebetween. The thermal cutoff may be mounted within the recovery casing in operable communication with the first recovery exhaust fan and configured to selectively restrict the first recovery exhaust fan based on a temperature at the thermal cutoff.

In another exemplary aspect of the present disclosure, an air conditioner unit is provided. The air conditioner unit may include a housing, an outdoor heat exchanger, an indoor heat exchanger, a compressor, an air plenum, a recovery casing, a first recovery exhaust fan, and a thermal cutoff. The housing may define an outdoor portion and an indoor portion. The outdoor heat exchanger assembly may be disposed in the outdoor portion and include an outdoor heat exchanger and an outdoor fan. The indoor heat exchanger assembly may be disposed in the indoor portion and include an indoor heat exchanger and an indoor fan. The compressor may be in fluid communication with the outdoor heat exchanger and the indoor heat exchanger to circulate a refrigerant between the outdoor heat exchanger and the indoor heat exchanger. The air plenum may be attached to the housing and be receivable within a structure wall. The recovery casing may be attached to the housing in fluid communication with the air plenum. The recovery casing may define an outdoor casing inlet downstream from the air plenum and an indoor casing outlet downstream from the outdoor casing inlet along an external recovery flow path. The recovery casing may further define an indoor casing inlet and an outdoor casing outlet along an internal recovery flow path. The first recovery exhaust fan may be mounted within the recovery casing along the external recovery flow path to motivate airflow therethrough. The thermal cutoff may be mounted within the recovery casing in operable communication with the first recovery exhaust fan and configured to selectively restrict the first recovery exhaust fan based on a temperature at the thermal cutoff.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
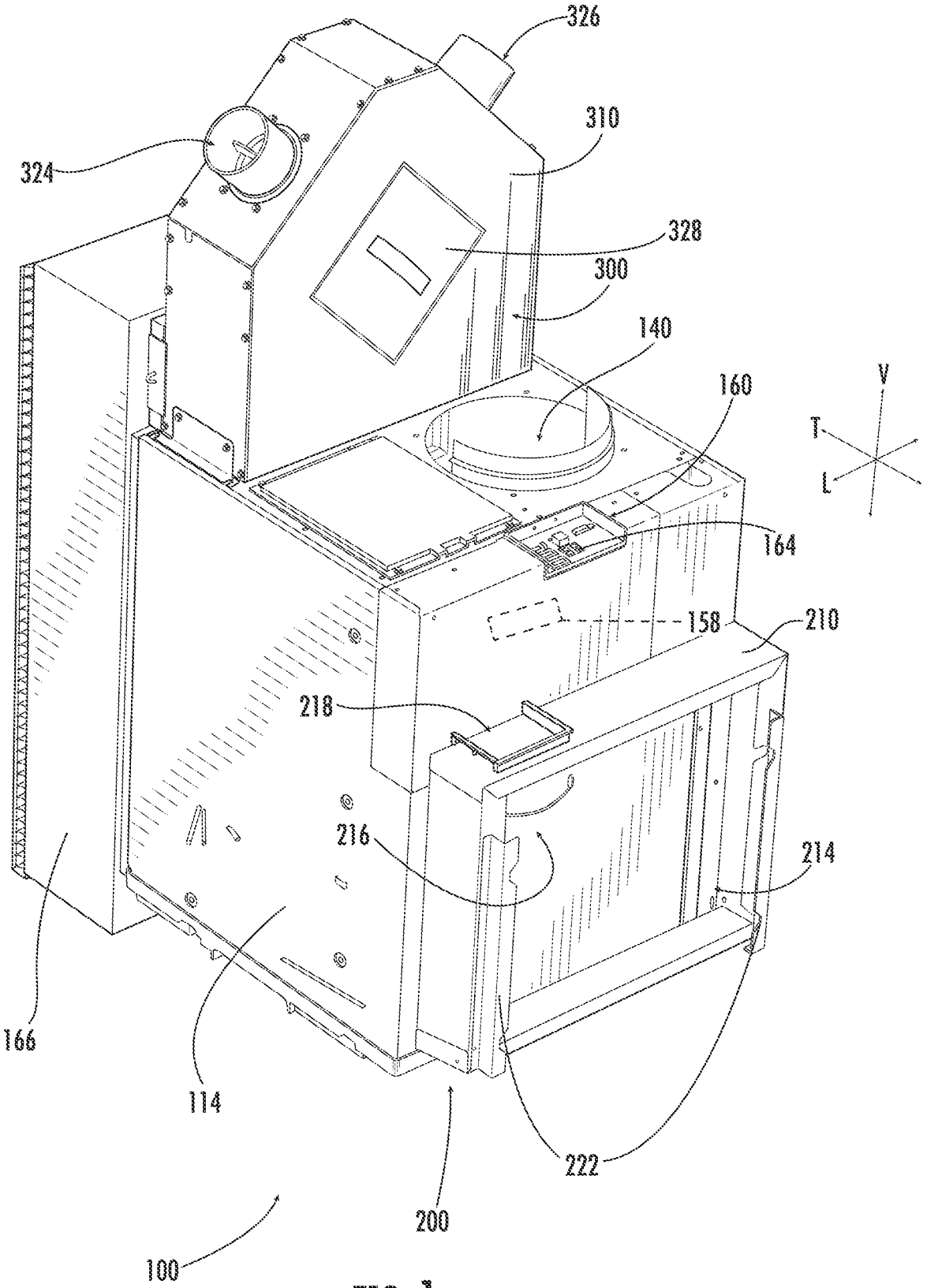
FIG. 1 provides a perspective view of an air conditioning appliance according to exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

The terms "upstream" and "downstream" refer to the relative flow direction with respect to fluid flow in a fluid pathway. For example, "upstream" refers to the flow direction from which the fluid flows, and "downstream" refers to the flow direction to which the fluid flows.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components or systems. For example, the approximating language may refer to being within a 10 percent margin (i.e., including values within ten percent greater or less than the stated value). In this regard, for example, when used in the context of an angle or direction, such terms include within ten degrees greater or less than the stated angle or direction (e.g., "generally vertical" includes forming an angle of up to ten degrees in any direction, such as, clockwise or counterclockwise, with the vertical direction V).

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Except as explicitly indicated otherwise, recitation of a singular processing element (e.g., "a controller," "a processor," "a microprocessor," etc.) is understood to include more than one processing element. In other words, "a processing element" is generally understood as "one or more processing element." Furthermore, barring a specific statement to the contrary, any steps or functions recited as being performed by "the processing element" or "said processing element" are generally understood to be capable of being performed by "any one of the one or more processing elements." Thus, a first step or function performed by "the processing element" may be performed by "any one of the one or more processing elements," and a second step or function performed by "the processing element" may be performed by "any one of the one or more processing elements and not necessarily by the same one of the one or more processing elements by which the first step or function is performed." Moreover, it is understood that recitation of "the processing element" or "said processing element" performing a plurality of steps or functions does not require that at least one discrete processing element be capable of performing each one of the plurality of steps or functions.

The present disclosure describes exemplary embodiments of an air conditioner to condition air within an indoor environment for a room, building, or residence. The air conditioner may include a separate indoor portion and outdoor portion within a housing, as well as a recovery assembly attached to the housing. The recovery assembly may supply ambient air to the indoor environment without flowing it through the housing. Moreover, the recovery assembly may be configured to recover some heat (e.g., from indoor air) or restrict airflow automatically (e.g., without direct user intervention) based on various temperatures at or near the recovery assembly.

Figure 2:
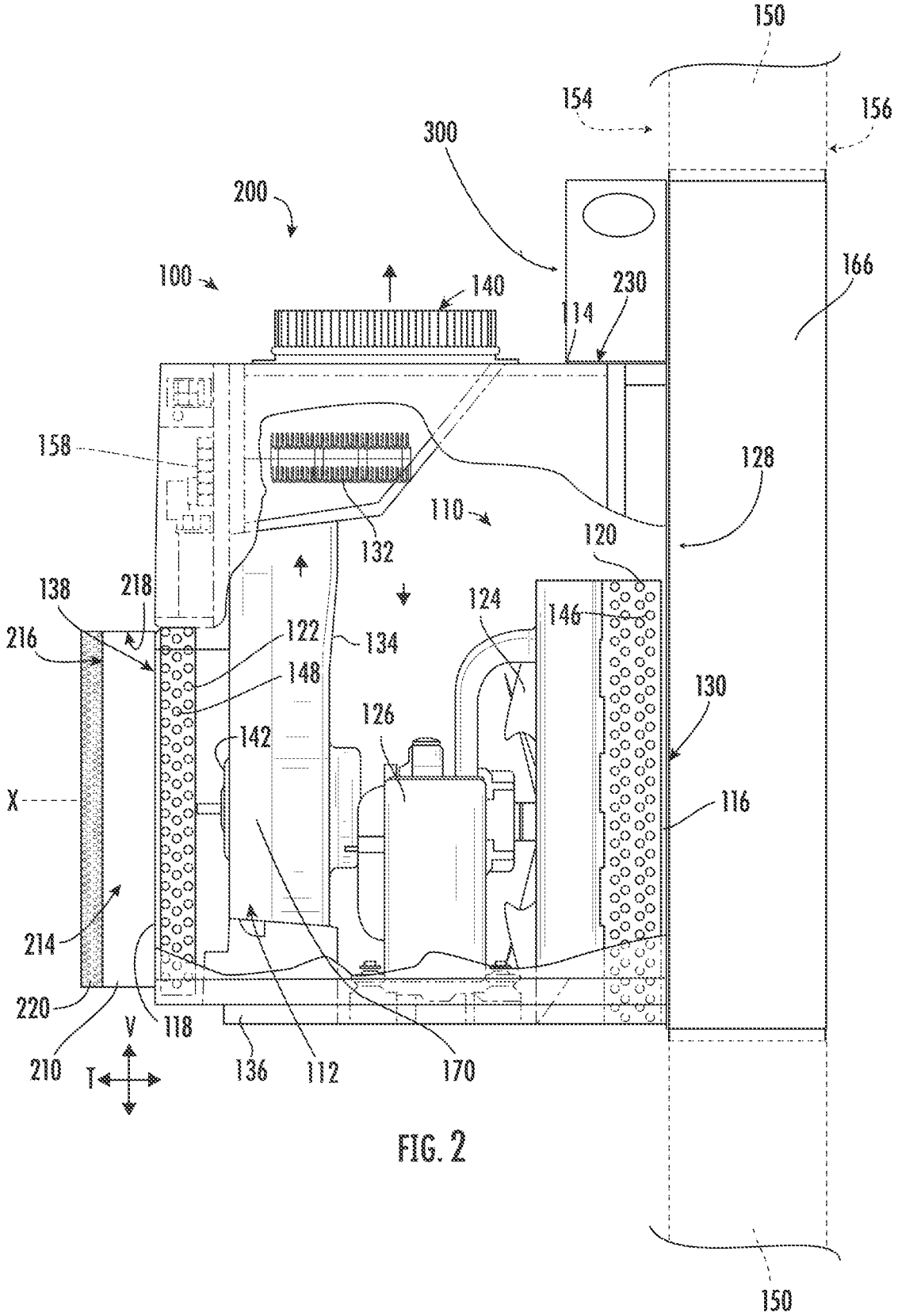
FIG. 2 provides a partially-transparent elevation view of the exemplary air conditioner unit of FIG. 1.
Figure 3:
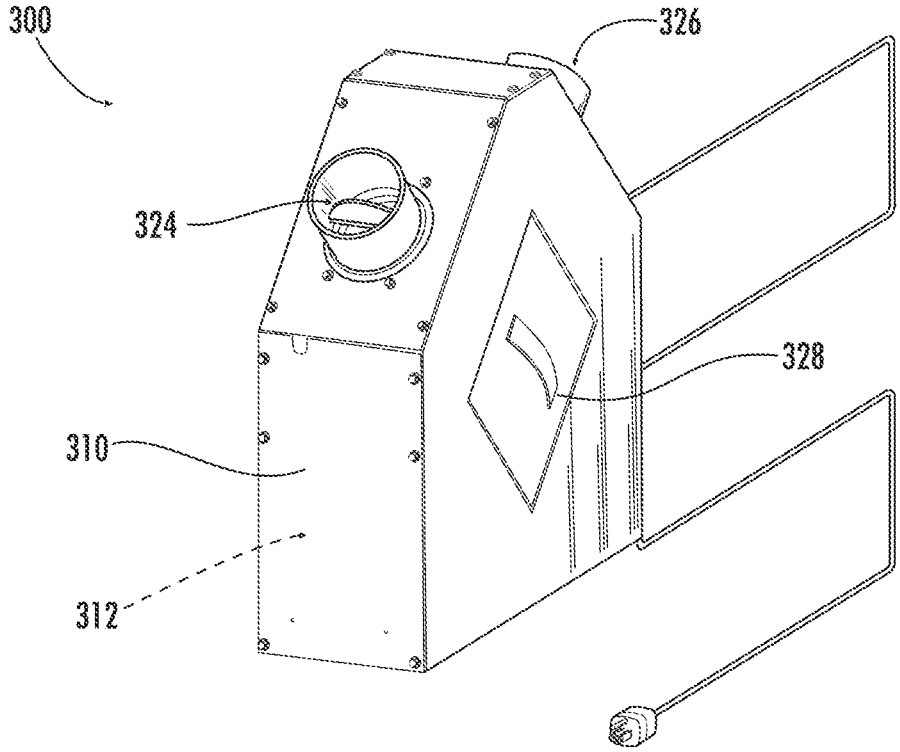
FIG. 3 provides a front perspective view of the recovery assembly of the exemplary air conditioning appliance of FIG. 1.
Figure 4:
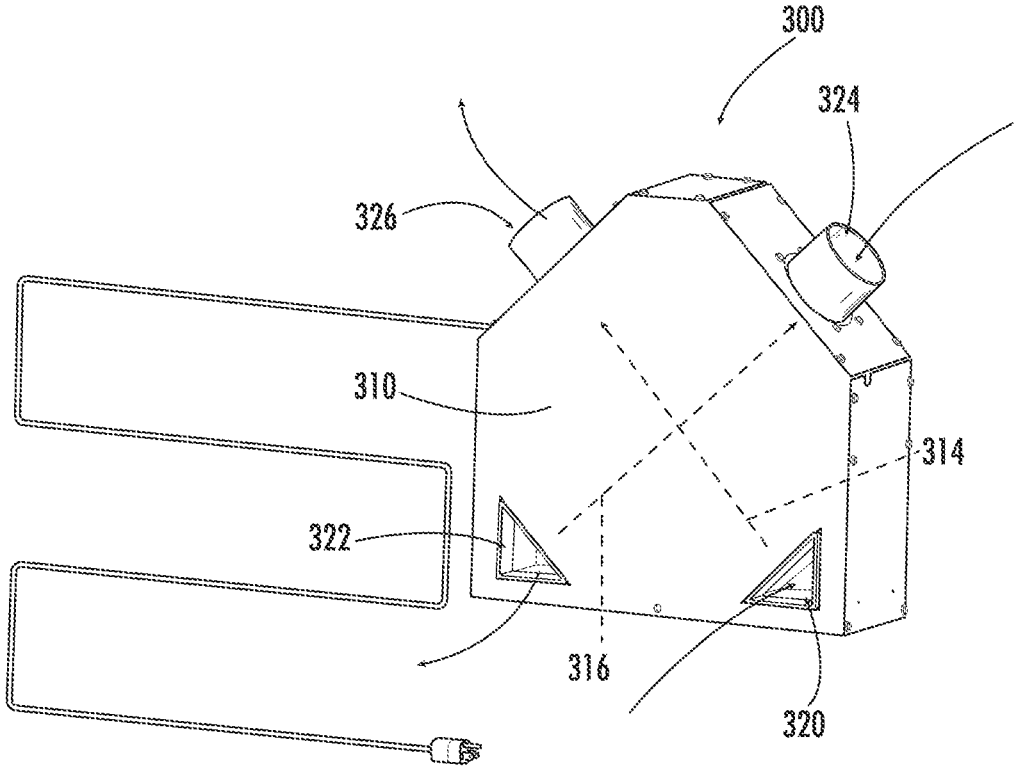
FIG. 4 provides a rear perspective view of the recovery assembly of the exemplary air conditioning appliance of FIG. 1.
Figure 5:
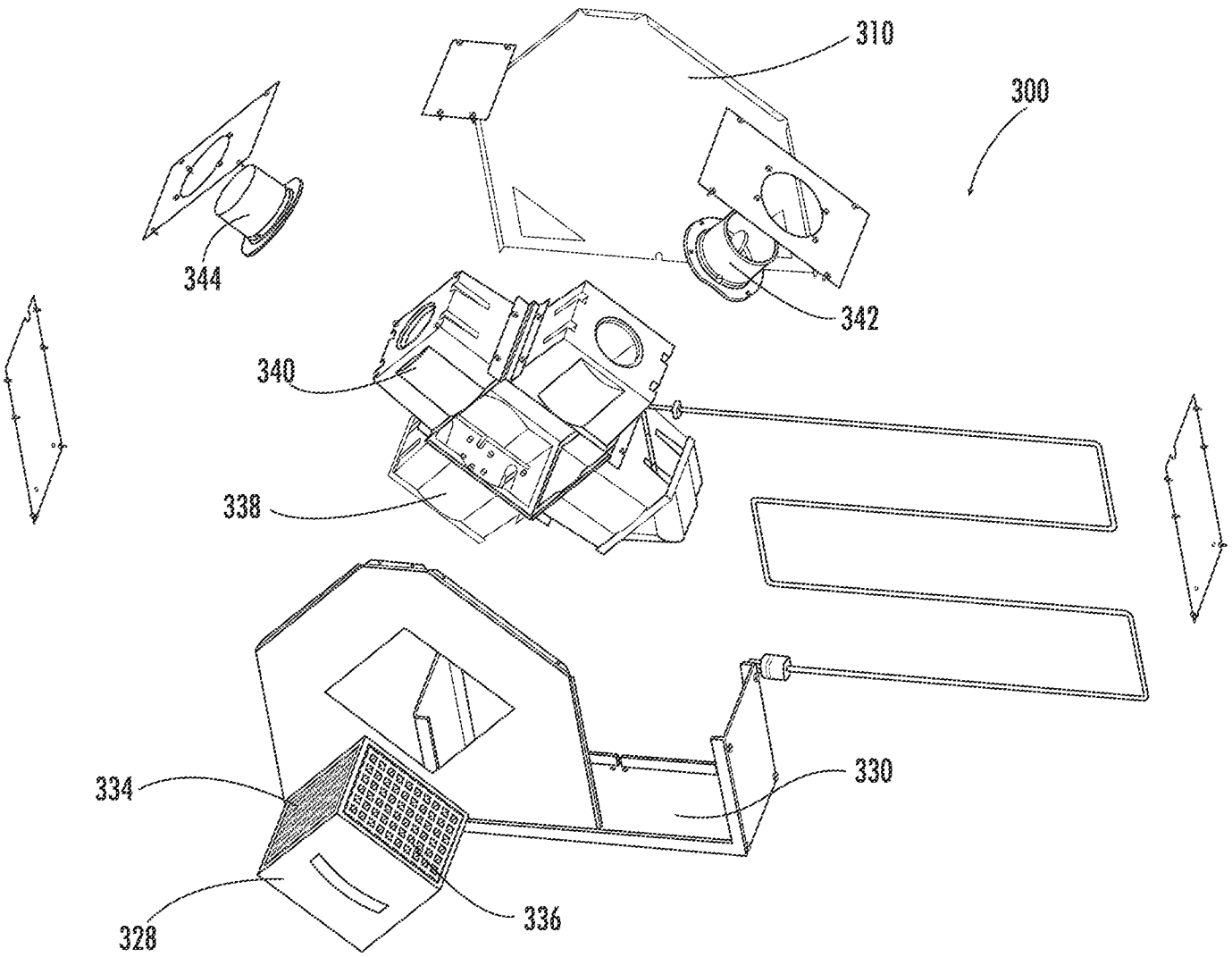
FIG. 5 provides an exploded perspective view of the recovery assembly of the exemplary air conditioning appliance of FIG. 1.
Figure 6:
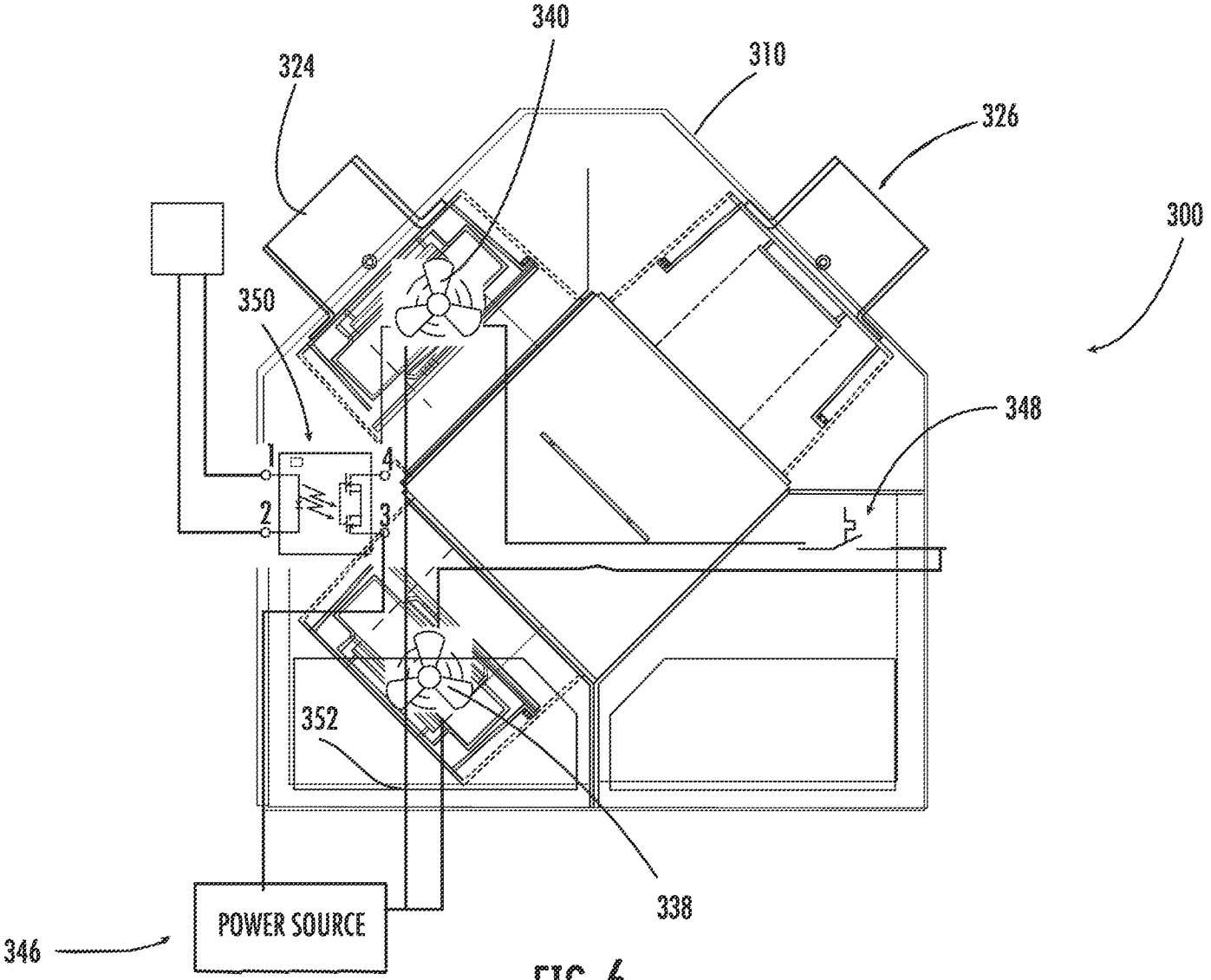
FIG. 6 provides a schematic plan view of the recovery assembly of the exemplary air conditioning appliance of FIG. 1.
Figure 7:
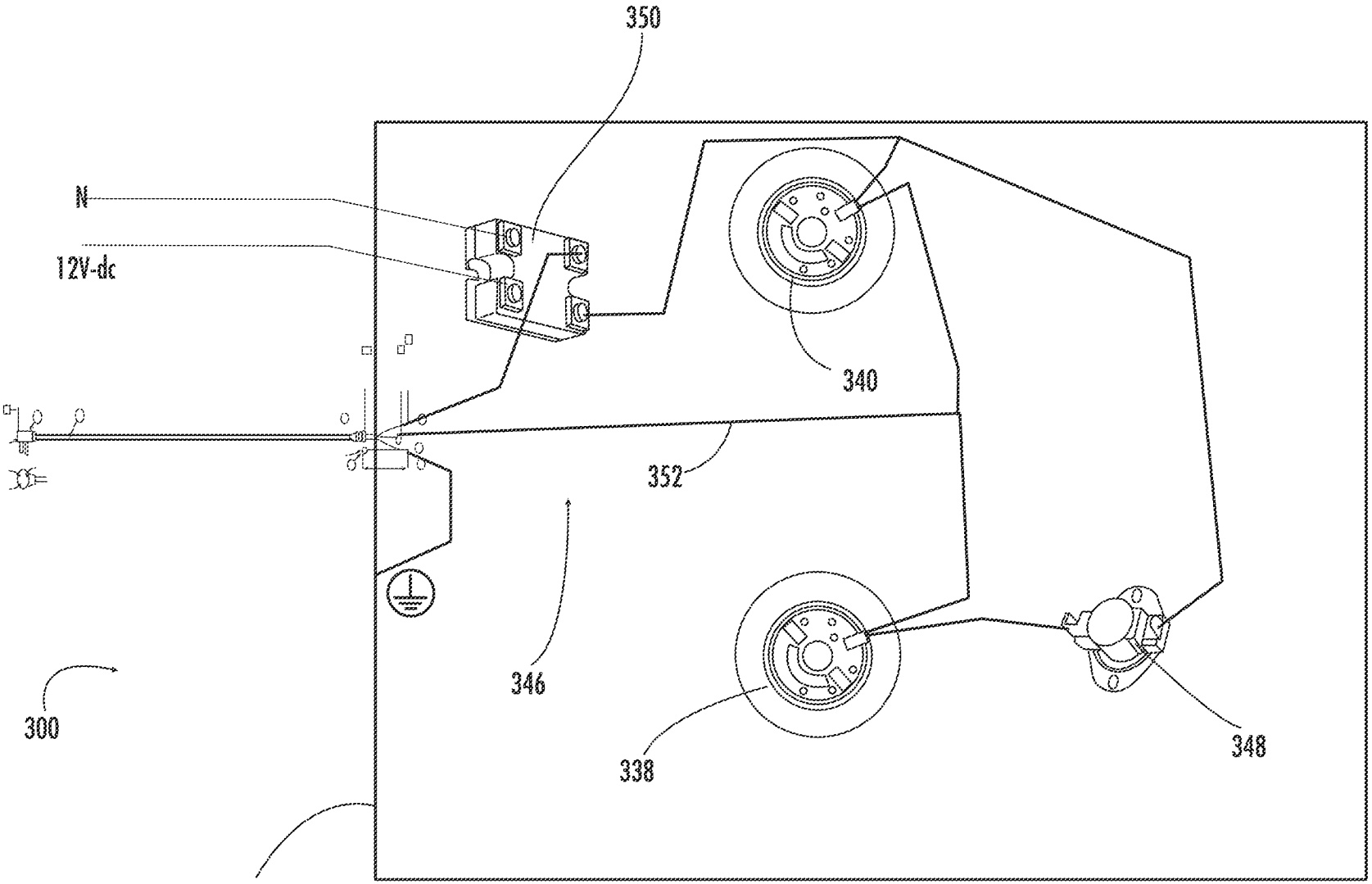
FIG. 7 provides another schematic view of the recovery assembly of the exemplary air conditioning appliance of FIG. 1.
Figure 8:
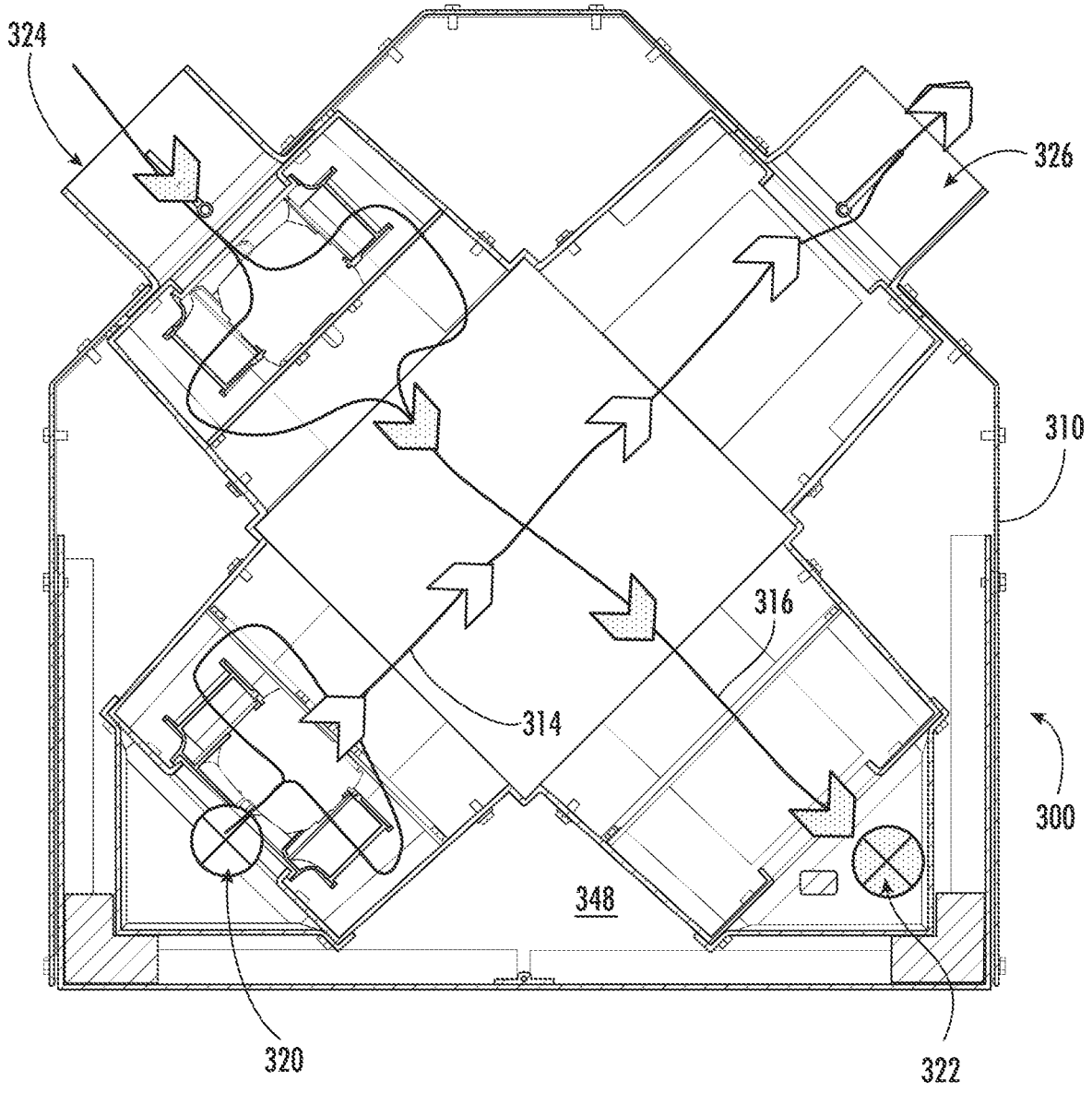
FIG. 8 provides another schematic plan view of the recovery assembly of the exemplary air conditioning appliance of FIG. 1, wherein airflow through the recovery assembly is illustrated.

Turning now to the figures, FIGS. 1 and 2 illustrate an exemplary air conditioner appliance (e.g., air conditioner 100). As shown, air conditioner 100 may be provided as a one-unit type air conditioner 100, such as a single-package vertical unit. Generally, air conditioner 100 defines a vertical direction V, lateral direction L, and transverse direction T. Each direction V, L, T is perpendicular to each other, such that an orthogonal coordinate system is generally defined.

Air conditioner 100 includes a package housing or cabinet 114 that extends along the vertical direction V between a downward bottom end 114A and an upward top end 114B, along a lateral direction L between a first lateral side 114C and a second lateral side 114D, and along the transverse direction T between a forward front end 114E and a rearward back end 114F. As shown, housing 114 defines an indoor portion 112 and an outdoor portion 110. In this regard, as used herein, the terms "cabinet," "housing," and the like are generally intended to refer to an outer frame or support structure for appliance 100 (e.g., including any suitable number, type, and configuration of support structures formed from any suitable materials, such as a system of elongated support members, a plurality of interconnected panels, or some combination thereof). It should be appreciated that housing 114 does not necessarily require an enclosure and may simply include open structure supporting various elements of appliance 100. By contrast, housing 114 may enclose some or all portions of an interior of housing 114. It should be appreciated that housing 114 may have any suitable size, shape, and configuration while remaining within the scope of the present subject matter.

In some embodiments, housing 114 contains various other components of the air conditioner 100. Housing 114 may include, for example, a rear opening 116 (e.g., with or without a grill or grate thereacross) and a front opening 118 (e.g., with or without a grill or grate thereacross) may be spaced apart from each other along the transverse direction T. The rear opening 116 may be part of the outdoor portion 110, while the front opening 118 is part of the indoor portion 112. Components of the outdoor portion 110, such as an outdoor heat exchanger 120, outdoor fan 124, and compressor 126 may be enclosed within housing 114 between front opening 118 and rear opening 116. In certain embodiments, one or more components of outdoor portion 110 are mounted on a basepan 136, as shown.

During certain operations, air may be drawn to outdoor portion 110 through rear opening 116. Specifically, an outdoor inlet 128 defined through housing 114 may receive outdoor air motivated by outdoor fan 124. Within housing 114, the received outdoor air may be motivated through or across outdoor fan 124. Moreover, at least a portion of the outdoor air may be motivated through or across outdoor heat exchanger 120 before exiting the rear opening 116 at an outdoor outlet 130. It is noted that although outdoor inlet 128 is illustrated as being defined above outdoor outlet 130, alternative embodiments may reverse this relative orientation (e.g., such that outdoor inlet 128 is defined below outdoor outlet 130) or provide outdoor inlet 128 beside outdoor outlet 130 in a side-by-side orientation, or another suitable discrete orientation.

As shown, indoor portion 112 may include an indoor heat exchanger 122, an indoor fan 142, or a heating unit (e.g., one or more resistive coils—not pictured). These components may, for example, be housed behind the front opening 118. A bulkhead 134 may generally support or house various other components or portions thereof of the indoor portion 112, such as the indoor fan 142. When assembled, 134 may generally separate and define the indoor portion 112 and outdoor portion 110 within housing 114. Additionally or alternatively, bulkhead 134 or indoor heat exchanger 122 may be mounted on basepan 136 (e.g., at a higher vertical position than outdoor heat exchanger 120), as shown.

In certain embodiments, a fan cowl 170 holds or at least partially encloses indoor fan 142. Such a fan cowl 170 may be attached to a separate wall or segment of bulkhead 134, as would generally be understood. In turn, fan cowl 170 may be included or formed with bulkhead 134.

During certain operations, air may be drawn to indoor portion 112 through front opening 118. Specifically, an indoor inlet 138 defined through housing 114 may receive indoor air motivated by indoor fan 142. At least a portion of the indoor air may be motivated through or across indoor heat exchanger 122 (e.g., before passing to fan cowl 170). From indoor fan 142, indoor air may be motivated and returned to the indoor area of the room through indoor outlet 140. Optionally, one or more conduits (not pictured) may be mounted on or downstream from indoor outlet 140 to further guide air from air conditioner 100. It is noted that although indoor outlet 140 is illustrated as generally directing air upward, it is understood that indoor outlet 140 may be defined in alternative embodiments to direct air in any other suitable direction.

Outdoor and indoor heat exchanger 120, 122 may be components of a thermodynamic assembly (e.g., sealed system), which may be operated as a refrigeration assembly (and thus perform a refrigeration cycle) or, in the case of the heat pump unit embodiment, a heat pump (and thus perform a heat pump cycle). Thus, as is understood, exemplary heat pump unit embodiments may be selectively operated perform a refrigeration cycle at certain instances (e.g., while in a cooling mode) and a heat pump cycle at other instances (e.g., while in a heating mode). By contrast, exemplary A/C exclusive unit embodiments may be unable to perform a heat pump cycle (e.g., while in the heating mode), but still perform a refrigeration cycle (e.g., while in a cooling mode).

The sealed system may, for example, further include compressor 126 (e.g., mounted on basepan 136) and an expansion device (e.g., expansion valve or capillary tube), both of which may be in fluid communication with the heat exchangers 120, 122 to flow refrigerant therethrough, as is generally understood. The outdoor and indoor heat exchanger 120, 122 may each include coils 146, 148, as illustrated, through which a refrigerant may flow for heat exchange purposes, as is generally understood.

It is noted that although a sealed system is described above, one of ordinary skill in the art would, in light of the present disclosure, understand that such a sealed system may be substituted for other suitable heat-exchange systems, such as a system relying on shape-memory alloys (SMA). For instance, a pair of discrete fluid circuits (e.g., a hot circuit and a cold circuit) each having a discrete volume of heat-carrying fluid (e.g., water, brine, glycol, air, etc.) may be separately connected to a compression unit housing a plurality of plate stacks each having one or more plates formed from one or more SMA material (e.g., copper-nickel-aluminum or nickel-titanium). Separate heat exchangers may generally be provided on the circuits in place of or as the above-described indoor heat exchanger and the outdoor heat exchanger. In particular, a first heat exchanger may be provided on the cold circuit (e.g., in place of the indoor heat exchanger of a sealed system) to absorb heat from the adjacent air and impart such absorbed heat to the heat-carrying fluid within the cold circuit. Similarly, a second heat exchanger may be provided on the hot circuit (e.g., in place of the outdoor heat exchanger of a sealed system) to release heat to the adjacent air from the heat-carrying fluid within the hot circuit.

The compression unit may facilitate or direct heat between the circuits. As an example, the compression unit may have four discrete plate stacks, each being separately compressed or released by a corresponding compressor or vice (e.g., hydraulic ram or electric actuator). During use, the plate stacks may be compressed and released (e.g., alternated between a compressed state or stroke and a released state or stroke) separately such that at any given moment one plate stack is compressed, one plate stack is released, one plate stack is mid-compression, and one plate stack is mid-release. Heat-carrying fluid in the cold circuit may flow through the first heat exchanger, before being directed (e.g., by a series of valves or pumps) into the plate stack that is currently compressed. The compressed plate stack may then be moved to the released state, in turn absorbing heat from the heat-carrying fluid before the heat-carrying fluid within the now-released plate stack is returned to the cold circuit (e.g., to repeat the cycle). In contrast to the cold circuit, heat-carrying fluid in the hot circuit may flow through the second heat exchanger and be directed (e.g., by a separate series of valves or pump) into the plate stack that is currently released. The released plate stack may then be compressed (i.e., moved to the compressed stated), in turn releasing heat from the plate stack to the heat-carrying fluid before the heat-carrying fluid within the now-compressed plate stack is returned to the hot circuit (e.g., to repeat the cycle). The use of four plate stacks may allow both circuits to run continuously. Moreover, such a process may be reversed, such that the above described hot circuit operates as a cold circuit, and vice versa.

Returning generally to FIGS. 1 and 2, a plenum 166 may be provided to direct air to or from housing 114. When installed, plenum 166 may be selectively attached to (e.g., fixed to or mounted against) housing 114 (e.g., via a suitable mechanical fastener, adhesive, gasket, etc.) and extend through a structure wall 150 (e.g., an outer wall of the structure within which air conditioner 100 is installed). For instance, plenum 166 may extend (e.g., parallel to the transverse direction T) through a hole or channel 152 in the structure wall 150 that passes from an internal surface 154 to an external surface 156. As will be described in greater detail below, a recovery assembly may be provided on, adjacent to, or otherwise in fluid communication with plenum 166 to selectively motivate air to or from the outdoor environment through the plenum 166.

In some embodiments, separate from or in addition to the recovery assembly, a make-up air assembly is provided to selectively provide ambient air from the outdoor environment (e.g., through the plenum 166) to the indoor environment treated by the air conditioning appliance 100.

Optionally, at least a portion of the make-up air assembly 200 supplies or directs outdoor air to the indoor portion 112. In some such embodiments, make-up air assembly 200 includes an intake conduit 210 that defines an intake passage 214 upstream from indoor inlet 138. As shown, intake conduit 210 extends outward from housing 114. For instance, intake passage 214 may extend along a passage axis X (e.g., horizontal or parallel to the transverse direction T), which the intake conduit 210 generally surrounds or radially bounds. In some such embodiments, intake passage 214 is parallel to passage axis X. When assembled, intake conduit 210 may be mounted to housing 114, such as on an outer surface 230 of housing 114. In turn, intake passage 214 may extend from a primary air inlet 216 (i.e., primary inlet), which is defined as an opening or aperture of intake conduit 210, to indoor inlet 138. Thus, primary air inlet 216 is spaced apart from indoor inlet 138 (e.g., along the transverse direction T). In some embodiments, primary air inlet 216 is coaxial with indoor inlet 138. For instance, both primary air inlet 216 and indoor inlet 138 may be defined along the passage axis X. In turn, intake passage 214 may be a linear passage from primary air inlet 216 to indoor inlet 138.

Along with defining primary air inlet 216, intake conduit 210 may define a secondary air inlet 218 (i.e., secondary inlet) connected to an outdoor air duct (not pictured, but may be connected to plenum 166 such that the outdoor air conduit extends downstream from the plenum 166 to the upstream primary air inlet 216). In particular, secondary air inlet 218 may be defined separate from primary air inlet 216. When assembled, secondary air inlet 218 may be spaced apart from primary air inlet 216. For instance, secondary air inlet 218 may be defined in fluid parallel to primary air inlet 216. Thus, airflow through secondary air inlet 218 to intake passage 214 may be distinct from airflow through primary air inlet 216. Moreover, upstream from intake passage 214, the airflows through secondary air inlet 218 and primary air inlet 216 may be independent from (i.e., not commingled with) each other.

In some embodiments, secondary air inlet 218 is defined along a non-parallel angle relative to primary air inlet 216 (i.e., such that primary air inlet 216 and secondary air inlet 218 are not defined along geometric parallel axes). For instance, secondary air inlet 218 may be defined through intake conduit 210 perpendicular to primary air inlet 216 (e.g., perpendicular to passage axis X). In optional embodiments, secondary air inlet 218 is defined above primary air inlet 216. Thus, airflow through secondary air inlet 218 to intake passage 214 may flow downward. In additional or alternative embodiments, secondary air inlet 218 is closer to indoor inlet 138 (e.g., relative to the passage axis X) than primary air inlet 216. Thus, secondary air inlet 218 may be proximal to indoor inlet 138 while primary air inlet 216 is distal to indoor inlet 138. It is understood that secondary air inlet 218 may be connected to one or more secondary air conduits (not pictured) in fluid communication with a make-up air source (e.g., with plenum 166 or another region distinct and spaced apart from primary air inlet 216) to supply make-up air directly to intake conduit 210 through secondary air inlet 216.

Optionally, a filter panel 220 may be disposed (e.g., selectively or removably disposed) on intake conduit 210. In particular, filter panel 220 may be disposed in fluid communication with intake passage 214 to filter air thereto. For instance, filter panel 220 may be in fluid communication with primary air inlet 216 while being spaced apart from secondary air inlet 218. During use, airflow to intake passage 214 through primary air inlet 216 may thus be forced through filter panel 220 in order to flow to intake passage 214. By contrast, airflow to intake passage 214 through secondary air inlet 218 may advantageously bypass filter panel 220 altogether. Optionally, indoor inlet 138 may be unobstructed by any filtration media, ensuring a direct flow path from intake passage 214 to the indoor portion 112. Notably, bypassing filter panel 220 may prevent significant resistance to make-up air (e.g., while ensuring filtration of most of the airflow, such as the non-makeup airflow to indoor inlet 138).

In some embodiments, filter panel 220 is disposed in front primary air inlet 216 (e.g., along the transverse direction T or otherwise outside from intake passage 214). Moreover, filter panel 220 may be upstream from primary air inlet 216. One or more mounting brackets 222 may be provided to hold filter panel 220 on intake conduit 210. For instance, as illustrated, a pair of mounting brackets 222 that each defining a discrete support channel to slidably receive filter panel 220 may be provided on opposite ends (e.g., opposite lateral ends or vertical ends) of intake conduit 210 or primary air inlet 216. As shown, each mounting bracket 222 may be opened at one end (e.g., a top end) while being closed at an opposite end (e.g., a bottom end) to support filter panel 220 or otherwise prevent filter panel 220 from sliding directly through (i.e., out of) the mounting brackets 222 during installation of filter panel 220 on intake conduit 210. Filter panel 220 itself may be provided as any suitable frame or structure including a suitable air filtration media (e.g., cellulose, fiberglass, foam, etc.).

The operation of air conditioner 100 including compressor 126 (and thus the sealed system generally), indoor fan 142, outdoor fan 124, heating unit 132, and other suitable components may be controlled by a control board or controller 158. Controller 158 may be in communication (via for example a suitable wired or wireless connection) to such components of the air conditioner 100. By way of example, the controller 158 may include a memory and one or more processing devices such as microprocessors, CPUs or the like, such as general or special purpose microprocessors operable to execute programming instructions or micro-control code associated with operation of air conditioner 100. The memory may be a separate component from the processor or may be included onboard within the processor. The memory may represent random access memory such as DRAM, or read only memory such as ROM or FLASH.

Air conditioner 100 may additionally include a control panel 160 and one or more user inputs 162, which may be included in control panel 160. The user inputs 162 may be in communication with the controller 158. A user of the air conditioner 100 may interact with the user inputs 162 to operate the air conditioner 100, and user commands may be transmitted between the user inputs 162 and controller 158 to facilitate operation of the air conditioner 100 based on such user commands. A display 164 may additionally be provided in the control panel 160, and may be in communication with the controller 158. Display 164 may, for example be a touchscreen or other text-readable display screen, or alternatively may simply be a light that can be activated and deactivated as required to provide an indication of, for example, an event or setting for the air conditioner 100.

Turning now especially to FIGS. 2 through 8, various views are provided to illustrate the recovery assembly 300 according to exemplary embodiments of the present disclosure. As shown, recovery assembly 300 includes a recovery casing 310, which may be separate from or in addition to housing 114. For instance, recovery casing 310 may be attached to housing 114 (e.g., above or radially spaced apart from outdoor inlet 128 or outdoor outlet 130). Optionally, recovery casing 310 may be disposed against the plenum 166 (e.g., in fluid communication therewith). Generally, recovery casing 310 includes one or more solid, non-permeable walls that define or enclose a casing cavity 312. Within the casing cavity 312, an external recovery flow path (EFP) 314 or an internal recovery flow path (IFP) 316 may be defined, as will be described in greater detail below.

In addition to casing cavity 312, recovery casing 310 further define various inlet or outlets (e.g., in or permitting fluid communication with casing cavity 312). For instance, recovery casing 310 may define an outdoor casing inlet 320, an outdoor casing outlet 322, an indoor casing inlet 324, or an indoor casing outlet 326. Together, the inlets and outlets may communicate air to the recovery casing 310 and, in particular, to the EFP 314 and the IFP 316.

In certain embodiments, recovery casing 310 defines an outdoor casing inlet 320 and an indoor casing outlet 326 in fluid communication with the outdoor casing inlet 320. The indoor casing outlet 326 may be downstream from the outdoor casing inlet 320 along the EFP 314. Optionally, the indoor casing outlet 326 may be defined above the outdoor casing inlet 320. Additionally or alternatively, the indoor casing outlet 326 may be defined across or proximal to an opposite lateral side of the recovery casing 310 from the outdoor casing inlet 320. For instance, the outdoor casing inlet 320 may be defined at a bottom corner of an outer face of recovery casing 310 (e.g., proximate a left side of recovery casing 310) while the indoor casing outlet 326 is defined at an upper perimeter face (e.g., proximate a right side of recovery casing 310). When assembled, the outdoor casing inlet 320 may be disposed downstream from the plenum 166 (e.g., above the outdoor outlet 130 or inlet 128), and may be in fluid parallel to outdoor inlet 128. Notably, outdoor casing inlet 320 may be proximal to housing 114 or plenum 166 (e.g., in comparison to indoor casing outlet 326).

In additional or alternative embodiments, recovery casing 310 defines an indoor casing inlet 324 and an outdoor casing outlet 322 in fluid communication with outdoor casing outlet 322. The indoor casing inlet 324 may be downstream from the outdoor casing outlet 322 along the IFP 316. Optionally, the outdoor casing outlet 322 may be defined below the indoor casing inlet 324.

Additionally or alternatively, the indoor casing inlet 324 may be defined across or proximal to an opposite lateral side of the recovery casing 310 from the outdoor casing outlet 322. For instance, the outdoor casing outlet 322 may be defined at a bottom corner of an outer face of recovery casing 310 (e.g., proximate a right side of recovery casing 310) while the indoor casing inlet 324 is defined at an upper perimeter face (e.g., proximate a left side of recovery casing 310). The outdoor casing outlet 322 may be laterally spaced apart from the outdoor casing inlet 320. Additionally or alternatively, the indoor casing inlet 324 may be laterally spaced apart from the indoor casing outlet 326. When assembled, the outdoor casing outlet 322 may be disposed upstream from the plenum 166 (e.g., above the outdoor outlet 130 or inlet 128), and may be in fluid parallel to outdoor inlet 128. Notably, outdoor casing outlet 322 may be proximal to housing 114 or plenum (e.g., in comparison to indoor casing inlet 324).

Within recovery casing 310, a heat exchanger core 328 may be provided. Specifically, heat exchanger core 328 may be mounted within casing cavity 312 in fluid communication with one or more of the inlets or outlets. In some embodiments, heat exchanger core 328 is disposed along the external recovery flow path 314 and the internal recovery flow path 316 to exchange heat therebetween. For instance, the heat exchanger core 328 may include two or more metal plates, conduits, or guide walls defining multiple (e.g., fluid parallel) channels 334, 336 for both the EFP 314 and the IFP 316. A drain pan 330 may be provided below (e.g., directly below) the exchanger core 328.

Optionally, a plurality of intersecting air channels 334, 336 may be defined such that two or more channels 334 of the EFP 314 intersect with two or more channels 336 of the IFP 316 (e.g., without intermixing air). For instance, relative to a horizontal or transverse plane, two or more channels 334 of the EFP 314 may be disposed at an angle between 0° and 180° (e.g., approximately) 90° relative to two or more channels 336 of the IFP 316. As noted above, the inlets and outlets may communicate air to the recovery casing 310 and, in particular, to the EFP 314 and the IFP 316. In some embodiments, the EFP 314 and IFP 316 are defined in fluid isolation from each other. In other words, the EFP 314 is fluidly isolated from the IFP 316 within the recovery casing 310. In turn, the channels 334 of the exchanger core 328 for the EFP 314 may be fluidly isolated from the channels 336 of the exchanger core 328 for the IFP 316.

In some embodiments, one or more recovery exhaust fans 338, 340 are provided to motivate air through the recovery casing 310 (e.g., separately or independently from the indoor fan 142 or outdoor fan 124). Specifically, a first recovery exhaust fan 338 may be mounted within the recovery casing 310 along the EFP 314 to motivate an airflow therethrough (e.g., from the outdoor casing inlet 320 to the indoor casing outlet 326). In certain embodiments, first recovery exhaust fan 338 is mounted upstream from the exchanger core 328 (e.g., proximal to outdoor casing inlet 320 and, thus, distal to indoor casing outlet 326). Optionally, a first passive damper 342 is provided within recovery casing 310 downstream from first recovery exhaust fan 338 or exchanger core 328 (e.g., proximal to indoor casing outlet 326 and, thus, distal to outdoor casing inlet 320), and may be configured to selectively close (e.g., in response to an inactive first recovery exhaust fan 338 or a lack of sufficient pressure from the same).

Separate from or in addition to first recovery exhaust fan 338, a second recovery exhaust fan 340 may be mounted within the recovery casing 310 along the IFP 316 to motivate an airflow therethrough (e.g., from the indoor casing inlet 324 to the outdoor casing outlet 322). In certain embodiments, second recovery exhaust fan 340 is mounted upstream from the exchanger core 328 (e.g., proximal to indoor casing inlet 324 and, thus, distal to outdoor casing outlet 322). Optionally, a second passive damper 344 is provided within recovery casing 310 upstream from second recovery exhaust fan 340 or exchanger core 328 (e.g., proximal to indoor casing inlet 324 and, thus, distal to outdoor casing outlet 322), and may be configured to selectively close (e.g., in response to an inactive second recovery exhaust fan 340 or a lack of sufficient pressure from the same).

In some embodiments, the recovery exhaust fan(s) are provided in operable communication with a dedicated casing circuit 346 that is in electrical communication with the exhaust fan(s) and configured to selectively activate the same. When assembled, the casing circuit 346 may be attached or mounted to recovery casing 310 (e.g., within recovery casing 310). Moreover, casing circuit 346 may be separate or independent from the controller 158. In turn, casing circuit 346 may automatically (e.g., without direct user input or instruction) activate one or more of the exhaust fans 338, 340 using power provided from a connected power source (e.g., via an electrical plug or wall socket), irrespective of any signals from the controller 158.

In certain embodiments, the casing circuit 346 includes a thermal cutoff 348. Specifically, thermal cutoff 348 may be mounted within recovery casing 310 in operable communication with the first recovery exhaust fan 338 (e.g., apart or isolated from second recovery exhaust fan 340). Thermal cutoff 348 may moreover be configured to selectively restrict the first recovery exhaust fan 338 based on a temperature at the thermal cutoff 348. For instance, thermal cutoff 348 may be configured to selectively open a corresponding cutoff switch in response to detecting a temperature at or below a predetermined or set opening temperature (e.g., less than or equal to 5 degrees Celsius). In some such embodiments, thermal cutoff 348 is provided along a portion of casing circuit 346 in series connection with first recovery exhaust fan 338. Thus, opening thermal cutoff 348 may deactivate or restrict activation of the first recovery exhaust fan 338.

Notably, especially cold ambient air may be prevented from flowing through EFP 314, which might otherwise hinder efficiency or permit frost accumulation within recovery casing 310.

Generally, any suitable (e.g., electromechanical) cutoff switch may be provided for the thermal cutoff 358. As an example, and would be understood in light of the present disclosure, the thermal cutoff 348 may include or be provided as a normally closed bimetallic switch in electrical (e.g., series) communication with the first recovery exhaust fan 338. As shown, thermal cutoff 348 may be mounted within recovery casing 310 (e.g., along or proximal to IFP 316 to detect temperature at the same). For instance, thermal cutoff 348 may be mounted downstream from exchanger core 328 (e.g., proximal to outdoor casing outlet 322 and, thus, distal to indoor casing inlet 324). In turn, detection of temperature downstream from exchanger core 328 along the IFP 316 may open the thermal cutoff 348, and thereby deactivating or restricting activation of the first recovery exhaust fan 338.

In additional or alternative embodiments, the casing circuit 346 includes an occupancy sensor 350. Specifically, occupancy sensor 350 may be mounted on, within, or proximal to recovery casing 310 in operable communication with the second recovery exhaust fan 340 (e.g., apart or isolated from first recovery exhaust fan 338). Generally, the occupancy sensor 350 is configured to generate or receive a signal indicating the presence or, alternatively, absence of a person within the same room or indoor environment as served by appliance 100. For instance, occupancy sensor 350 may include a sensor switch configured to open in response to detecting (or receiving an occupancy signal indicating) no user is present.

For instance, occupancy sensor 350 may include (or be in operable communication with) an infrared motion sensor, acoustic or ultrasonic sensor, radio frequency sensor, audio sensor, touch sensor, computer system, etc. to directly detect a human body or scheduled occupancy within the indoor environment. Additionally or alternatively, occupancy sensor 350 may include (or be in operable communication with) a keycard reader positioned within the indoor environment or on a door thereto. Thus, swiping a mated identification or access card at the keycard reader may indirectly indicate a user is present within the indoor environment and, thereby, prompt transmission of an indirect occupancy signal.

Occupancy sensor 350 may be configured to selectively activate/rotate irrespective of the thermal cutoff 348. In some such embodiments, occupancy sensor 350 is provided along a portion of casing circuit 346 in series connection with second recovery exhaust fan 340 while a secondary connection path 352 is also provided (e.g., in electrical parallel to the thermal cutoff 348 to connect second recovery exhaust fan 340 to the power source even if thermal cutoff 348 is open). Thus, opening thermal cutoff 348 may leave second recovery exhaust fan 340 able to activate. Optionally, opening the casing circuit 346 at occupancy sensor 350 (e.g., the switch corresponding to the same) may notably deactivate or restrict activation of both exhaust fans 338, 340.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An air conditioner unit comprising:

an air plenum receivable within a structure wall along a transverse direction through a channel defined by the structure wall from an internal surface to an external surface;

a recovery casing attached to the air plenum, the recovery casing defining an outdoor casing inlet downstream from the air plenum and an indoor casing outlet above and downstream from the outdoor casing inlet along an external recovery flow path, the recovery casing further defining an indoor casing inlet and an outdoor casing outlet along an internal recovery flow path;

a first recovery exhaust fan mounted within the recovery casing along the external recovery flow path to motivate airflow therethrough;

a heat exchanger core disposed along the external recovery flow path and the internal recovery flow path to exchange heat therebetween; and a thermal cutoff mounted within the recovery casing in operable communication with the first recovery exhaust fan and configured to selectively restrict the first recovery exhaust fan based on a temperature at the thermal cutoff, wherein the recovery casing is disposed against the air plenum, above a housing of the air conditioner unit and at least a portion of the channel.

2. The air conditioner unit of claim 1, wherein the thermal cutoff comprises a normally closed bimetallic switch in electrical communication with the first recovery exhaust fan.

3. The air conditioner unit of claim 1, wherein the thermal cutoff includes a set opening temperature less than or equal to 5 degrees Celsius.

4. The air conditioner unit of claim 1, wherein the heat exchanger core is disposed along the external recovery flow path (EFP) and the internal recovery flow path (IFP) to exchange heat therebetween.

5. The air conditioner unit of claim 4, wherein the EFP is fluidly isolated from the IFP within the recovery casing.

6. The air conditioner unit of claim 5, wherein the heat exchanger core defines a plurality of intersecting air channels.

7. The air conditioner unit of claim 1, further comprising a second recovery exhaust fan mounted within the recovery casing along the internal recovery flow path.

8. The air conditioner unit of claim 7, further comprising an occupancy sensor in operable communication with the second recovery exhaust fan.

9. The air conditioner unit of claim 8, wherein the second recovery exhaust fan is configured to selectively activate irrespective of the thermal cutoff.

10. An air conditioner unit comprising:

a housing defining an outdoor portion and an indoor portion;

an outdoor heat exchanger assembly disposed in the outdoor portion and comprising an outdoor heat exchanger and an outdoor fan;

an indoor heat exchanger assembly disposed in the indoor portion and comprising an indoor heat exchanger and an indoor fan;

a compressor in fluid communication with the outdoor heat exchanger and the indoor heat exchanger to circulate a refrigerant between the outdoor heat exchanger and the indoor heat exchanger;

an air plenum attached to the housing and receivable within a structure wall along a transverse direction through a channel defined by the structure wall from an internal surface to an external surface;

a recovery casing attached to the housing in fluid communication with the air plenum, the recovery casing defining an outdoor casing inlet downstream from the air plenum and an indoor casing outlet downstream from the outdoor casing inlet along an external recovery flow path, the recovery casing further defining an indoor casing inlet and an outdoor casing outlet along an internal recovery flow path;

a first recovery exhaust fan mounted within the recovery casing along the external recovery flow path to motivate airflow therethrough; and a thermal cutoff mounted within the recovery casing in operable communication with the first recovery exhaust fan and configured to selectively restrict the first recovery exhaust fan based on a temperature at the thermal cutoff, wherein the recovery casing is disposed against the air plenum above the outdoor portion and at least a portion of the channel.

11. The air conditioner unit of claim 10, wherein the thermal cutoff comprises a normally closed bimetallic switch in electrical communication with the first recovery exhaust fan.

12. The air conditioner unit of claim 10, wherein the thermal cutoff includes a set opening temperature less than or equal to 5 degrees Celsius.

13. The air conditioner unit of claim 10, further comprising a heat exchanger core disposed along the external recovery flow path (EFP) and the internal recovery flow path (IFP) to exchange heat therebetween.

14. The air conditioner unit of claim 13, wherein the EFP is fluidly isolated from the IFP within the recovery casing.

15. The air conditioner unit of claim 14, wherein the heat exchanger core defines a plurality of intersecting air channels.

16. The air conditioner unit of claim 10, further comprising a second recovery exhaust fan mounted within the recovery casing along an internal recovery flow path.

17. The air conditioner unit of claim 16, further comprising an occupancy sensor in operable communication with the second recovery exhaust fan.

18. The air conditioner unit of claim 17, wherein the second recovery exhaust fan is configured to selectively activate irrespective of the thermal cutoff.

* * * * *